US009976331B2

(12) United States Patent
Albrecht

(10) Patent No.: US 9,976,331 B2
(45) Date of Patent: May 22, 2018

(54) DEVICE FOR MOVING A MOVABLE FURNITURE PART IN AN OPENING DIRECTION IN RELATION TO A BASIC FURNITURE STRUCTURE OF AN ITEM OF FURNITURE

(71) Applicant: Grass GmbH, Hoechst (AT)

(72) Inventor: Markus Albrecht, Lustenau (AT)

(73) Assignee: Grass GmbH, Hoechst (AT)

( * ) Notice: Subject to any disclaimer, the term of this patent is extended or adjusted under 35 U.S.C. 154(b) by 0 days. days.

(21) Appl. No.: 15/236,736

(22) Filed: Aug. 15, 2016

(65) Prior Publication Data

US 2017/0049228 A1 Feb. 23, 2017

(30) Foreign Application Priority Data

Aug. 21, 2015 (DE) ..... 20 2015 104 436 U

(51) Int. Cl.

| | |
|---|---|
| ***A47B 88/04*** | (2006.01) |
| ***E05F 15/00*** | (2015.01) |
| ***A47B 88/463*** | (2017.01) |
| ***A47B 88/16*** | (2006.01) |

(52) U.S. Cl.

CPC ..... *E05F 15/00* (2013.01); *A47B 88/0477* (2013.01); *A47B 88/16* (2013.01); *A47B 88/463* (2017.01); *A47B 2210/0094* (2013.01)

(58) Field of Classification Search

CPC ..... A47B 88/46; A47B 88/47; A47B 88/463; A47B 88/467; A47B 88/0477; A47B 88/16; E05F 15/00

USPC ..... 312/319.1, 330.1, 334.1, 334.4

See application file for complete search history.

(56) References Cited

U.S. PATENT DOCUMENTS

| | | | | |
|---|---|---|---|---|
| 9,622,578 | B2 * | 4/2017 | Goetz | A47B 88/57 |
| 2014/0312756 | A1 | 10/2014 | Ng | |
| 2015/0374125 | A1 * | 12/2015 | Goetz | A47B 88/0477 312/319.1 |

FOREIGN PATENT DOCUMENTS

| | | |
|---|---|---|
| AT | 514065 | * 10/2014 |
| DE | 20 2005 002 433 U1 | 6/2005 |
| DE | 20 2008 013 230 U1 | 4/2010 |
| DE | 20 2012 003 537 U1 | 7/2013 |
| DE | 20 2014 101 848 U1 | 6/2014 |

(Continued)

OTHER PUBLICATIONS

Extended European Search Report (Application No. 16182956.9) dated Apr. 26, 2017.

(Continued)

*Primary Examiner* — James O Hansen
(74) *Attorney, Agent, or Firm* — Burr & Brown, PLLC

(57) ABSTRACT

A device for moving a movable furniture part, the device including a force accumulator such that by way of the device which is fitted to an item of furniture the movable furniture part in the case of an opening procedure by action of the force accumulator is capable of being put in the opening direction, wherein in the case of a movement of the movable furniture part in the closing direction, a charging procedure of the force accumulator is performed, wherein a front gap between the movable furniture part and the basic furniture structure is configured on the item of furniture in a closed state of the movable furniture part, wherein the front gap is adjustable by way of an adjustment assembly.

9 Claims, 11 Drawing Sheets

(56) References Cited

FOREIGN PATENT DOCUMENTS

WO WO 2015/058222 A1 * 4/2015

OTHER PUBLICATIONS

Partial European Search Report (Application No. 16182956.9) dated Jan. 23, 2017.
German Search Report (Application No. 20 2015 104 436.4) dated May 13, 2016.

* cited by examiner

DEVICE FOR MOVING A MOVABLE FURNITURE PART IN AN OPENING DIRECTION IN RELATION TO A BASIC FURNITURE STRUCTURE OF AN ITEM OF FURNITURE

This application claims the benefit under 35 USC § 119(a)-(d) of German Application No. 20 2015 104 436.4 filed Aug. 21, 2015, the entirety of which is incorporated herein by reference.

FIELD OF THE INVENTION

The present invention relates to a device for moving a movable furniture part in an opening direction in relation to a basic furniture structure of an item of furniture, and an item of furniture having such a device.

BACKGROUND OF THE INVENTION

In the case of furniture parts such as, for example, drawers, furniture doors, or furniture flaps which are movably received on a basic furniture structure of an item of furniture, guide units, hinges, and fittings are employed for influencing the movement of the respective furniture part.

An additional function for influencing the movement of the furniture part is provided in some embodiments of the respective device. This relates to systems for providing an opening function, for example. These systems may be designed in such a manner that the former require a front gap, on account of which it is possible for a user to activate a so-called touch-latch function which unblocks a force accumulator for opening the item of furniture.

SUMMARY OF THE INVENTION

The present invention is based on the object of providing a device of the type referred to at the outset which comprises an improved installation for adjusting the front gap.

The present invention proceeds from a device for moving a movable furniture part in an opening direction in relation to a basic furniture structure of an item of furniture, wherein the movable furniture part by way of guide means is capable of being put in the opening direction and into a closing direction that is counter to the opening direction. The device has a force accumulator, wherein by way of the device which is fitted to the item of furniture the movable furniture part in the case of an opening procedure of the movable furniture part by action of the force accumulator is capable of being put in the opening direction, and wherein in the case of a movement of the movable furniture part in the closing direction, a charging procedure of the force accumulator is performed. A front gap between the movable furniture part and the basic furniture structure is configured on the item of furniture in a closed state of the movable furniture part, wherein the front gap is adjustable by way of an adjustment assembly, wherein the movable furniture part is capable of being put in motion from the closed state in the closing direction, and wherein the movement length of the movable furniture part in the closing direction is designed in such a manner that the charged force accumulator is unlocked.

Preferably, the movable furniture part is configured as a drawer or a flap, and the drawer or flap is movably guided on the basic furniture structure by way of guide means, for example, pull-out rails or hinges.

Advantageously, the device is disposed on the movable furniture part, in particular, on a lower side of a drawer base.

However, the device may also be attached to guide means of the furniture part, and/or on the basic furniture structure.

The adjustment assembly may be designed so as to discretely and/or continuously adjust the front gap between the movable furniture part and the basic furniture structure in the opening direction.

The adjustment assembly may be composed of metal, for example, steel, and/or of a sheet-metal, plastics, wood, or a combination of these materials.

It is conceivable that the adjustment assembly is designed so as to be independent of other elements such as, for example, an ejector or an activator of the force accumulator of the device according to the present invention on the item of furniture and/or on the movable furniture part and/or on guide means of the furniture part.

In one advantageous embodiment of the present invention, the adjustment length of the adjustment assembly is proportional, preferably linearly proportional, to the adjustment length of the front gap.

The substantial aspect of the present invention is now to be seen in that the adjustment assembly comprises an elastic member.

Advantageously, the elastic member is configured so as to be resilient and/or elastically deformable and/or noise-absorbing.

For example, an clicking noise may be avoided or at least be minimized in the case of contact between an ejector and an entrainment element of the movable furniture part and/or the guide means of the furniture part and/or the basic furniture structure in the case of the opening and/or closing procedure of the movable furniture part.

If and when the device is disposed on the movable furniture part, the entrainment element is configured on the guide means of the furniture part and/or on the basic furniture structure, in particular, in a positionally fixed manner in relation to the basic furniture structure. If and when the device is disposed in a positionally fixed manner on guide means of the furniture part and/or on the basic furniture structure, the entrainment element is configured on the movable furniture part.

For example, the elastic member is designed from plastics, in particular, from rubber, and/or metal and/or wood and/or a combination of these materials.

In one advantageous design embodiment of the present invention, the adjustment assembly comprises a setting element and a housing.

The elastic member may be provided between the setting element and that housing of the adjustment assembly on which the setting element is disposed.

Advantageously, the adjustment assembly is disposed on an ejector and/or on a device housing and/or on the basic furniture structure and/or on guide means of the furniture part.

For example, the adjustment assembly may be screwed and/or clip-fitted and/or adhesively bonded and/or riveted to an ejector and/or to a device housing and/or to the item of furniture, for example, to the basic furniture structure and/or to the guide means of the furniture part.

Moreover, it is conceivable that the adjustment assembly by way of and/or by the use of an elastic member is disposed on an ejector of the device and/or on a device housing and/or on the item of furniture and/or on guide means of the furniture part.

Advantageously, the adjustment assembly is disposed on guide means in such a manner that in the case of a movement of the movable furniture part, the adjustment assembly is conjointly moved in relation to the basic furniture structure.

Moreover, it is conceivable that the adjustment assembly is disposed on guide means in such a manner that in the case of a movement of the movable furniture part, the adjustment assembly remains in a fixed position on the guide means in relation to the basic furniture structure.

Advantageously, the adjustment assembly is operable without tools.

For example, the setting element of the adjustment assembly may be configured so as to be re-adjustable by way of a manual intervention by a user; in particular, the setting element may be disposed on the housing of the adjustment assembly so as to be rotatable by a handle. On account thereof, a user may modify a position of the setting element on the housing of the adjustment assembly and thus set the front gap in a comparatively simple manner.

Advantageously, the setting element of the adjustment assembly is configured as a set screw and/or set pin. For example, a position of the setting element on the housing of the adjustment assembly may be modified, for example, from the outside by a user, by way of rotation, in particular, without tools.

It is furthermore proposed that the adjustment assembly is configured on an attachment portion of an ejector of the device.

For example, the attachment portion makes available a plurality of attachment positions, and the attachment positions are configured in such a manner that the latter in the closing and/or opening direction of the movable furniture part are advantageously utilizable in a modular grid.

For example, the adjustment assembly may be clip-fitted and/or clamped and/or screwed in a comparatively simple manner to an attachment position of the attachment portion, for example, in the manner of a bayonet. On account thereof, a comparatively simple adjustment of the front gap in steps is advantageously possible in a comparatively large length range.

Advantageously, the adjustment assembly is disposed on an ejector in such a manner that in the case of a movement of the movable furniture part and/or of the ejector, the adjustment assembly is conjointly moved.

It is also of advantage for a setting element of the adjustment assembly to be configured so as to be self-locking.

The setting element may be configured on the housing of the adjustment assembly in such a manner that the front gap of the item of furniture may be adjusted by an, in particular, stepless positional modification of the setting element on the housing of the adjustment assembly.

If and when the setting element is configured so as to be self-locking, the setting element may automatically remain in an adjusted position on the housing of the adjustment assembly, for example.

The setting element may advantageously be configured in such a manner that the length of the setting element is modifiable. For example, the setting element is composed of two parts, and a first part of the setting element is fixedly disposed on the adjustment assembly, and a second part of the setting element is configured so as to be movable in relation to the first part of the setting element. On account thereof, it is likewise possible for the front gap of the item of furniture to be, in particular, continuously adjusted in a comparatively short length range.

Moreover, it is conceivable that setting elements of dissimilar configuration may be disposed on the housing of the adjustment assembly.

It is also conceivable that the housing of the adjustment assembly is configured in such a manner that setting elements of dissimilar length may be disposed on the housing of the adjustment assembly.

In one advantageous modification of the present invention, the adjustment assembly comprises an elastic stop member, wherein the elastic stop member is configured on the adjustment assembly in such a manner that the elastic stop member may interact with an entrainment element of the movable furniture part and/or of the guide means of the furniture part and/or of the basic furniture structure.

For example, the elastic stop member is disposed on the setting element on the adjustment assembly; in particular, the elastic stop member is configured on the setting element in such a manner that said elastic stop member acts between the setting element and an entrainment element of the movable furniture part and/or of the guide means of the furniture part and/or of the basic furniture structure.

Advantageously, the elastic stop member is configured so as to be resilient and/or elastically deformable and/or noise-absorbing. On account thereof, a noise which is disturbing to a user, for example, clicking, upon contact with the entrainment element in the case of an opening and/or closing procedure of the movable furniture part may be avoided and/or minimized.

In particular, the adjustment assembly has two elastic stop members.

A first elastic stop member may be configured on the setting element of the adjustment assembly, and a second elastic stop member may be disposed on the housing of the adjustment assembly.

The first elastic stop member may be designed so as to interact with an entrainment element which is configured on guide means of the furniture part and/or on the basic furniture structure and/or on the movable furniture part, for example. The second elastic stop member may be disposed on the housing of the adjustment assembly and interact with a contact element of the activator of the force accumulator of the device.

It is furthermore proposed that the housing of the adjustment assembly comprises a stop element, wherein the stop element is designed in such a manner so as to predefine a minimum and/or maximum position of the setting element of the adjustment assembly on the housing of the adjustment assembly.

In one further preferred design embodiment of the present invention, the minimum position of the setting element on the housing of the adjustment assembly corresponds to an adjustable minimum front gap, and the maximum position of the setting element on the housing of the adjustment assembly corresponds to an adjustable maximum front gap between the movable furniture part and the basic furniture structure in the opening direction.

Moreover, it is advantageous for the adjustment assembly to be disposed on the movable furniture part.

It is conceivable that the adjustment assembly is disposed on a face which faces the interior of the item of furniture, in particular, on the internal side of a front wall of a drawer of the movable furniture part.

In one design embodiment of the present invention which is moreover favorable, the adjustment assembly which is disposed on the movable furniture part interacts with an, in particular, elastic stop member on an end side of the basic furniture structure.

Preferably, the adjustment assembly is configured on the movable furniture part in such a manner that the adjustment assembly interacts with an elastic stop member of an entrainment element of the furniture part and/or of the basic furniture structure. For example, the adjustment assembly is configured on that device that is disposed on the movable furniture part.

It is also advantageous for the adjustment assembly to be disposed on an activator of the device.

If and when the adjustment assembly is disposed on an activator of the device, it is conceivable that the activator comprises the housing of the adjustment assembly.

Advantageously, the adjustment assembly is disposed on the activator in such a manner that the adjustment assembly may interact with an entrainment element of the movable furniture part and/or of the guide means of the furniture part and/or of the basic furniture structure.

It is also conceivable for the adjustment assembly to be disposed on the activator, and for the activator by way of the adjustment assembly to interact with an ejector of the device and/or with an entrainment element in such a manner that in the case of movement of the movable furniture part from the closed state on the furniture part in the closing direction, unlocking of the charged force accumulator is performed.

In one advantageous modification of the present invention, the adjustment assembly is disposed on guide means of the item of furniture; the adjustment assembly may be disposed on an attachment portion of the guide means of the furniture part.

Advantageously, the adjustment assembly is disposed on a central rail, in particular, on a basic structure rail for a drawer on the furniture part, on an attachment portion.

For example, the attachment portion of the guide means comprises a plurality of attachment positions, and the attachment positions are configured in such a manner that the latter in the closing and/or opening direction of the movable furniture part are utilizable in a modular grid. On account thereof, the front gap may advantageously be set in a particularly discrete manner.

For example, if and when the adjustment assembly is disposed on the guide means of the item of furniture, and the device is disposed on the movable furniture part, for example, the adjustment assembly is designed as an entrainment element or is configured on an entrainment element. In particular, the adjustment assembly by means of an elastic stop member acts as an entrainment element on an ejector of the device in such a manner that in the case of movement of the movable furniture part from the closed state on the furniture part in the closing direction unlocking of the charged force accumulator is performed.

Advantageously, the adjustment assembly is disposed so as to be positionally fixed on the basic furniture structure.

In one advantages embodiment of the device, the adjustment assembly is disposed on an end side of the basic furniture structure, wherein the end side of the basic furniture structure in the closed state of the movable furniture part may at least be partially obscured by the movable furniture part.

It is also conceivable that the adjustment assembly is disposed on an internal lateral face of the basic furniture structure, in the direction of an interior of the item of furniture. Advantageously, the one internal lateral face is aligned so as to be parallel with a side wall of the movable furniture part. In particular, the internal lateral face of the basic furniture structure is aligned so as to be parallel with an opening and/or closing direction of the movable furniture part.

The basic furniture structure may be designed in such a manner that the adjustment assembly may be disposed on the basic furniture structure in a plurality of different positions in the movement direction of the movable furniture part. On account thereof, the front gap may be advantageously adjusted; in particular, the front gap may be adjusted in discrete steps.

BRIEF DESCRIPTION OF THE DRAWINGS

Further features and advantages of the present invention are explained in more detail by means of exemplary embodiments which are schematically illustrated in the figures.

DETAILED DESCRIPTION OF THE INVENTION

Figure 1:
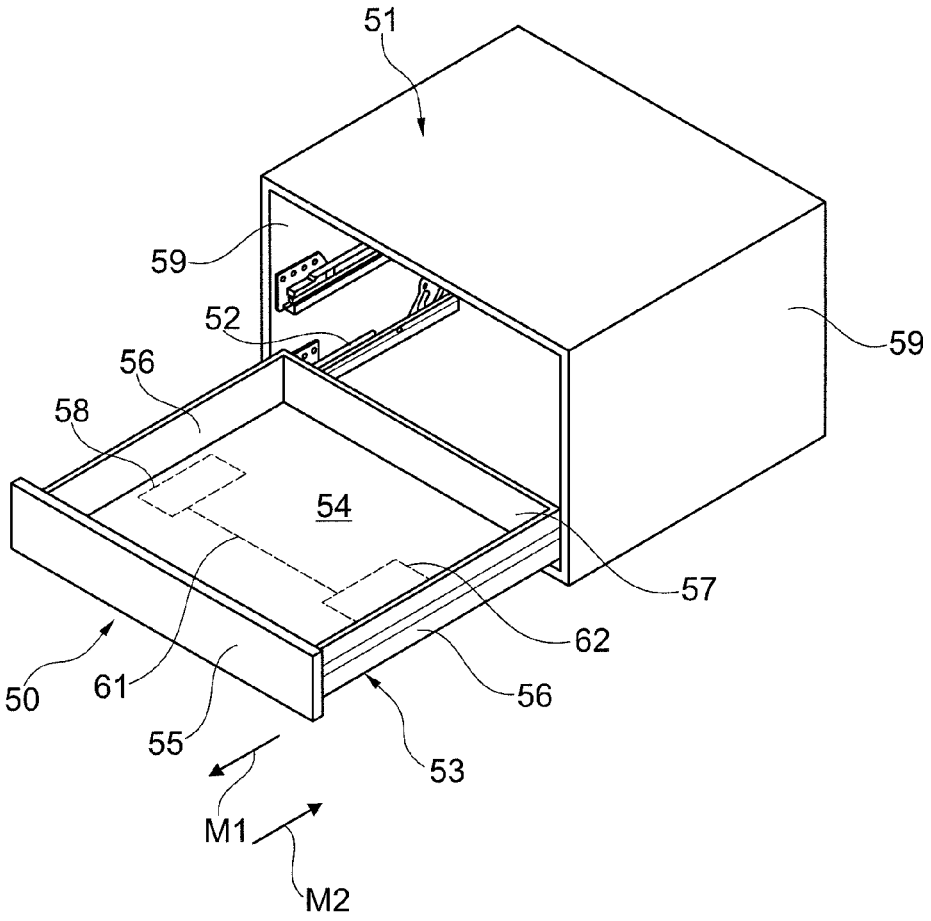
FIG. 1 shows an item of furniture according to the present invention in a perspective view from obliquely above, having a drawer in a completely opened state on a basic furniture structure.

A item of furniture 50 according to the present invention, having a box-shaped basic furniture structure 51 and a drawer 53 which by way of guide means 52 is movably guided, is illustrated in FIG. 1. The drawer 53 comprises a drawer base 54, a drawer front 55, side walls 56, and a rear drawer wall 57. Two guide means 52 with identical action for guiding the drawer 53 are present in each case between each side wall 56 of the drawer 53 and an associated basic-structure side wall 59. A device 58 according to the present invention (illustrated with dashed lines), for moving or ejecting, respectively, the furniture part which is configured as a drawer 53 in the opening direction M1 is disposed on a lower side of the drawer base 54.

Figure 2:
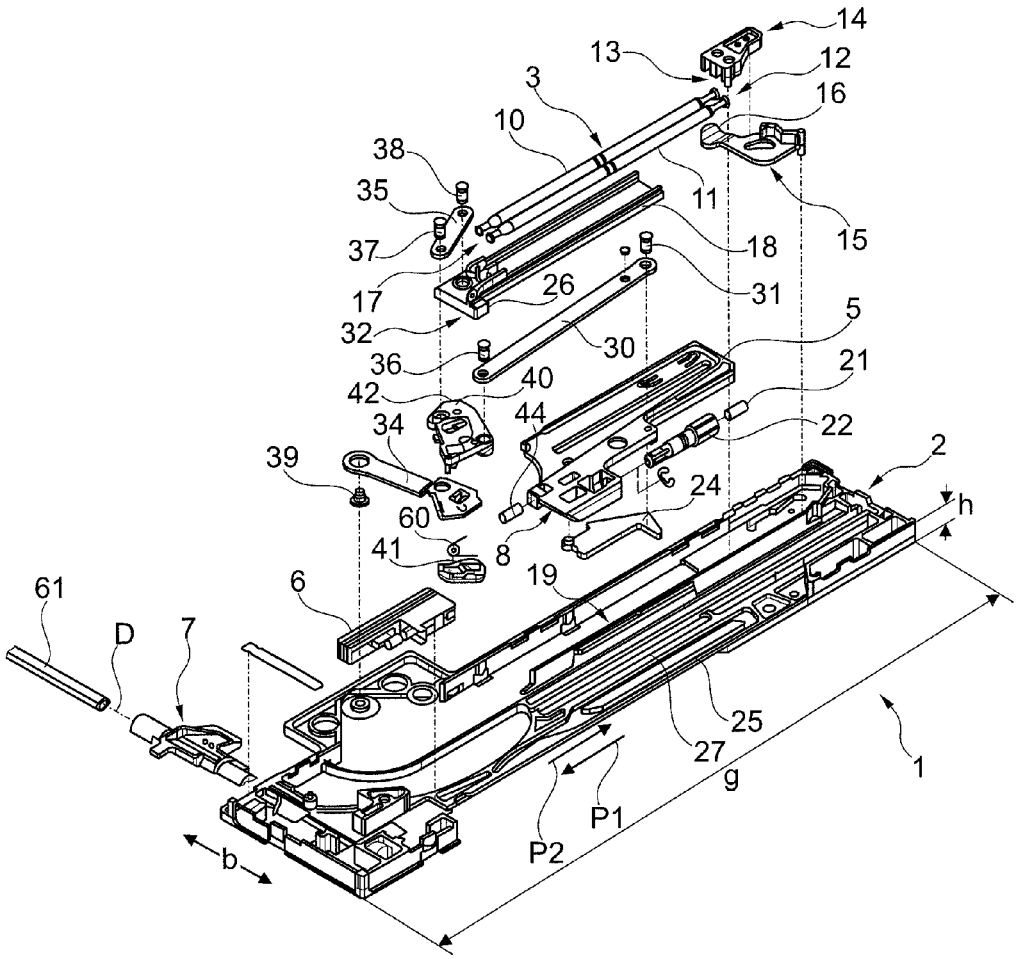
FIG. 2 shows a device according to the present invention, without a cover component, in a exploded illustration.

FIG. 2 shows the exploded illustration of the device 58 which is configured as an ejector unit 1 for the drawer 53.

The ejector unit 1 serves for the force-assisted ejection of the drawer 53 across a first part-distance of the opening movement of the drawer 53 in relation to the basic furniture structure 51, from a closed position in the opening direction M1.

The drawer 53 by way of the guide means 52, for example, two identical part-pullout units or full-pullout units, is mounted on the basic furniture structure 51 so as to be displaceable in the directions M1 and M2.

Alternatively, the ejector unit 1 may be disposed on the basic furniture structure 51 or on the guide means 52 of the item of furniture 50.

The ejector unit 1 comprises inter alia a base plate 2, a force accumulator 3, a coupling installation 4, an ejector 5, an activator 6, and a locking member 7.

Figure 9:
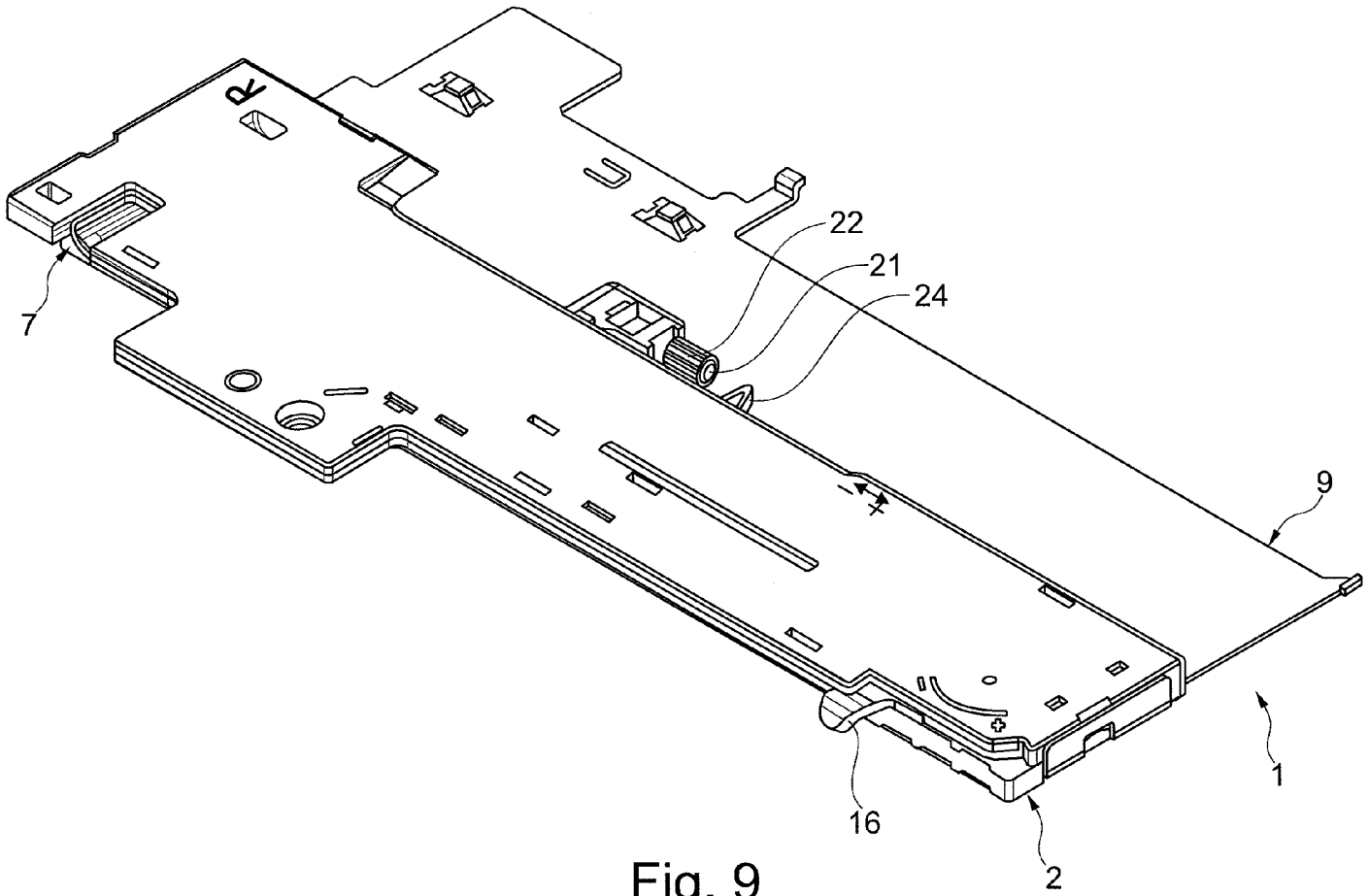
FIG. 9 shows the device according to FIG. 5, having the cover part, in a perspective view from obliquely below toward a second main side of the device.

A housing of the ejector unit 1 comprises the base plate 2 and a cover component 9 which is visible in FIG. 9. The ejector unit 1 may be disposed on the lower side of the drawer base 54 and/or on the guide means 52 by way of the housing or by way of the cover component 9 and/or the base plate 2, respectively.

Retaining portions, guide contours, stop members, and/or receptacle portions for linking the individual components of the ejector unit 1 are configured on the base plate 2. The base plate 2 is designed substantially as a rectangular, elongate or strip-shaped component, having a comparatively minor height h of approx. 5 to 15 millimeters, for example. The base plate 2 furthermore has a width b of approx. 4 to 10 centimeters, and a length g.

According to the exemplary embodiment shown, the force accumulator 3 comprises two identical coil springs 10, 11 which configure a spring pack and which are disposed in parallel. At a first end 12 of the force accumulator 3, the coil springs 10, 11 are disposed on an adjustable fixed mounting 13. The fixed mounting 13 comprises a movable mounting part 14 on which the coil springs 10, 11 are received in a releasable yet fixed manner, and a set part 15 having an operating portion 16 by way of which a user may adjust from the outside a position of the end 12 of the force accumulator 3 in a modifiable and positionally fixed manner. On account thereof, an effect of force of the force accumulator 3 on the a drawer 53 may advantageously be pre-adjusted in the case of the opening procedure of the drawer 53.

The associated ends of the coil springs 10, 11 are fastened to a slide-type motion element 18 at a second end 17 of the force accumulator 3. The slide-type motion element 18 by way of an associated guide contour 19 is linearly guided on the base plate 2 so as to be movable in a movement direction P1 and in an opposite movement direction P2.

The movement directions P1 and P2 of the motion element 18 (cf. FIGS. 2, 3) run parallel with the opening direction M1 of the drawer 53 and with a closing direction M2 which is counter thereto.

If and when the ejector unit 1 is disposed in a positionally fixed manner on the basic furniture structure 51 and/or on a stationary part of the guide means 52, the opening direction of the drawer 53 corresponds to the direction P1, and the closing direction of the drawer 53 corresponds to the direction P2.

Herebelow, an assembled state of the ejector unit 1 on the drawer base 54 is assumed.

Figure 3:
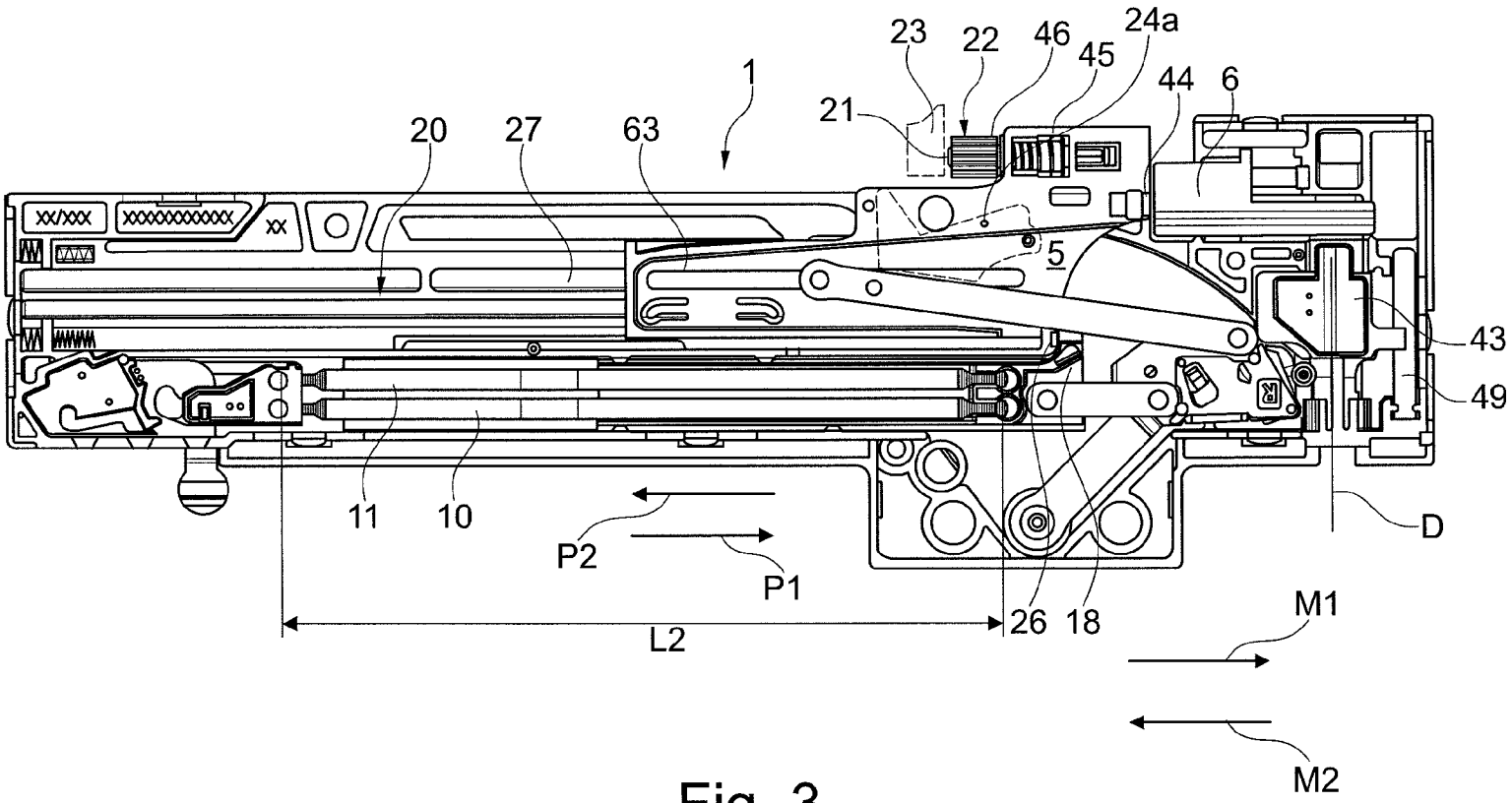
FIGS. 3 to 8 show the device according to FIG. 2, in an assembled state, in a plan view of a first main side, in various operational states.
Figure 7:
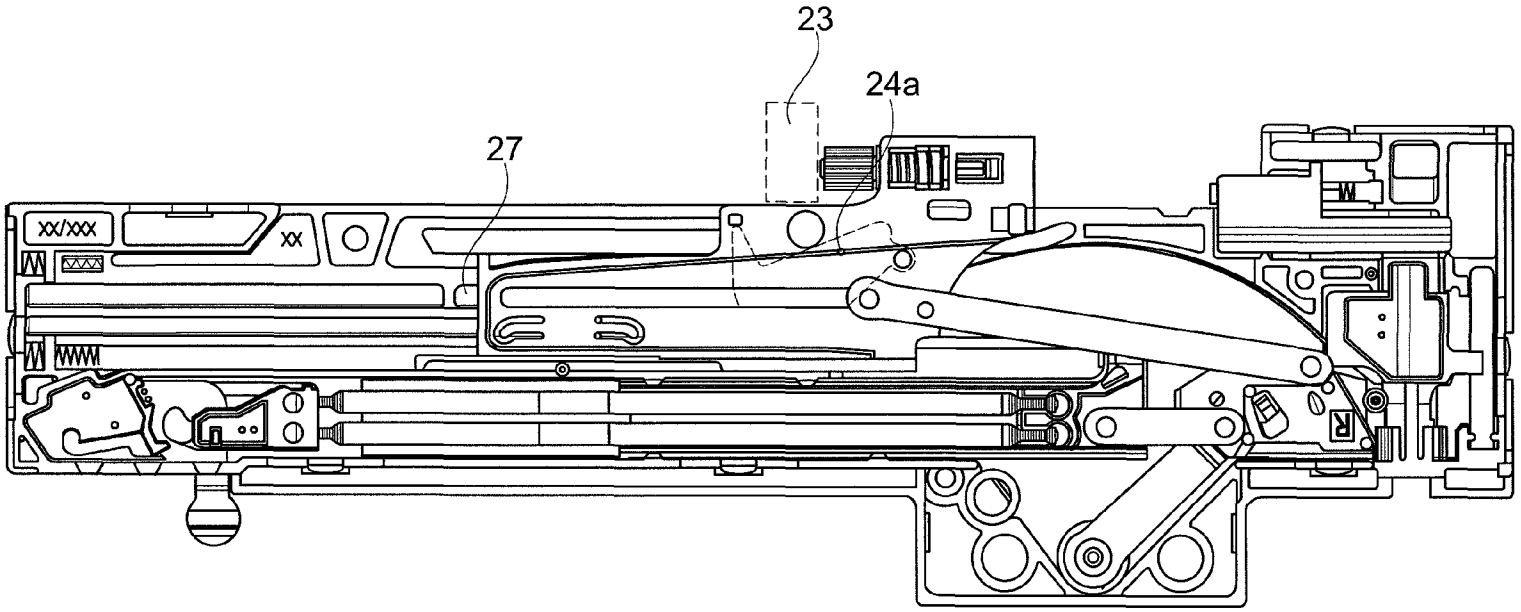
Figure 8:
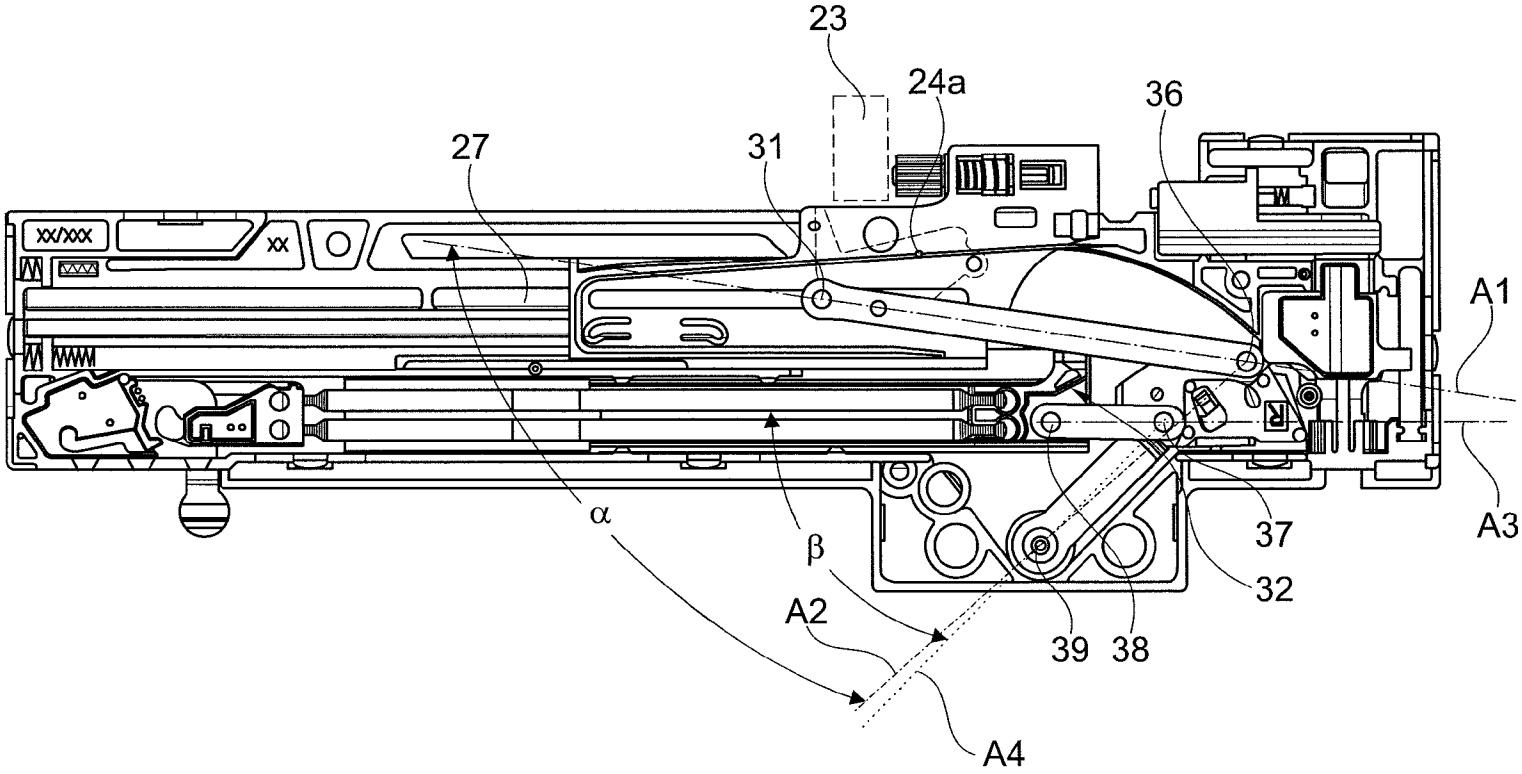

FIGS. 3, 7 and 8 show the ejector unit 1 in a tensioned state of the force accumulator 3, in which the coil springs 10, 11 are elongated or are tensioned so as to be under a tensile load, respectively; herein, the motion element 18 in relation to a retracted position in the direction P2 is offset on the base plate 2 in the direction P1 and is retained in a tensioned position.

Figure 5:
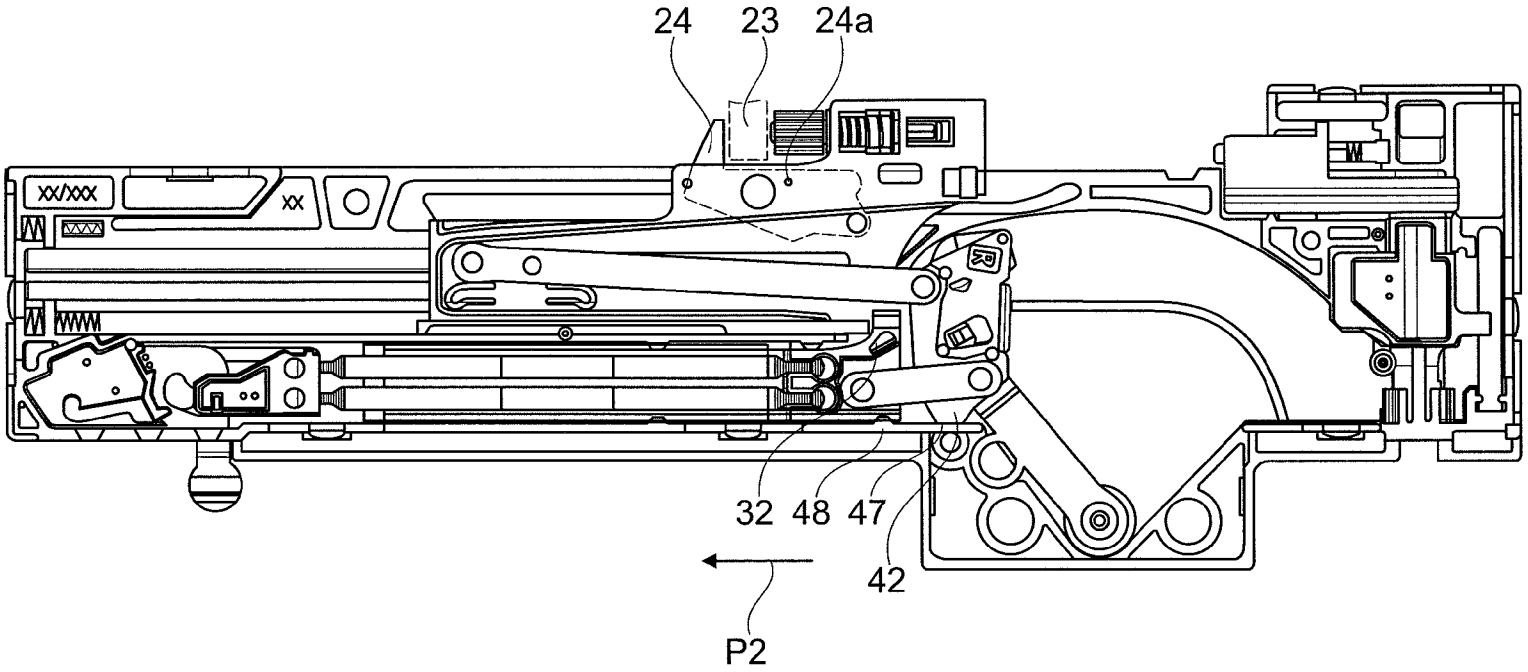
Figure 6:
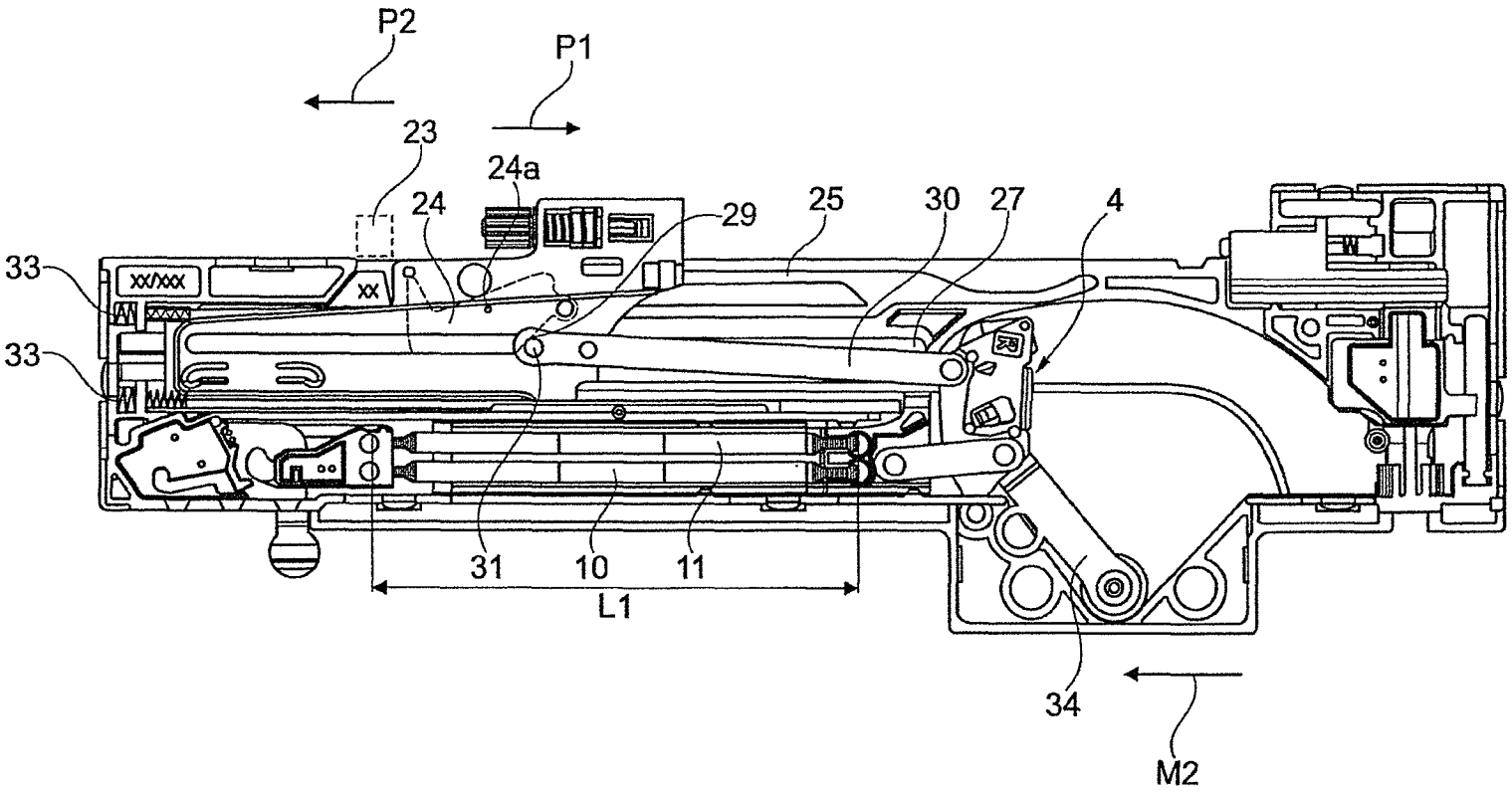

FIGS. 5 and 6 show the ejector unit 1 in a discharged basic state of the force accumulator 3, in which the coil springs 10, 11 are furthermore tensioned under a tensile load but to a lesser degree, having a length L1.

In the tensioned state of the force accumulator 3 the coil springs 10, 11 have a length L2 which is greater than L1.

A retaining member 32 having a stop element 26 is present on the motion element 18. The stop element 26 in the case of a force-assisted opening procedure is in contact with an ejector 5.

By way of the coupling installation 4, the force accumulator 3 or the motion element 18, respectively, is operationally connected to the ejector 5, preferably exclusively in the case of the closing procedure of the drawer 53. In particular, the ejector 5 is movable to and fro exclusively in a linear manner, or so as to be parallel with the movement direction of the motion element 18, respectively, in the directions P1 and P2. To this end, a linear guide 20 which is adapted to guide portions, for example, on one side of the ejector 5 is configured on the base plate 2.

Figure 4:
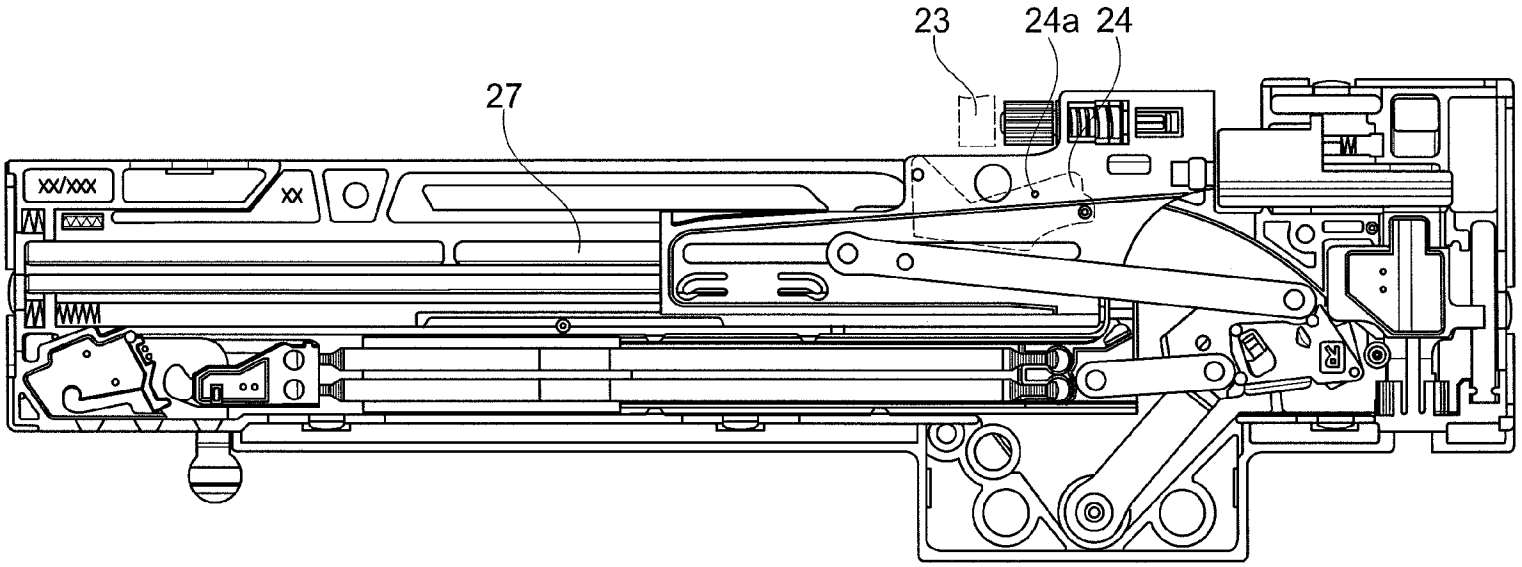

An opening procedure of the drawer 53, caused by the ejector unit 1, takes place exclusively by way of a direct operational connection of the force accumulator 3 to the ejector 5, by way of the motion element 18 which moves in the direction P2. To this end, the stop element 26 which is advantageously designed so as to be elastic and thus prevents or at least dampens any sound which is disturbing to the user when the motion element 18 impacts the ejector 5 in the opening procedure of the drawer 53 is configured on the motion element 18 (FIGS. 3, 4 and 5).

A front-gap adjustment assembly 8 comprises a housing 45 and a set screw 22 having a contact portion 21. Moreover, an ashlar-shaped opening 72 is configured on the housing 45. By virtue of the opening 72, four internal walls are configured in the interior of the housing 45, wherein two mutually opposite internal walls are designed as stops 69, 70 for an annular stop element 66 of the set screw 22.

The housing 45 of the front-gap adjustment assembly 8 is configured on the ejector 5 on the attachment portion 65 and by means of an elastic member 67 which is designed in the shape of a cam is clamped or clip-fitted to the cover component 9, and is movably guided on a guide portion 68 on the cover component 9.

Figure 10:
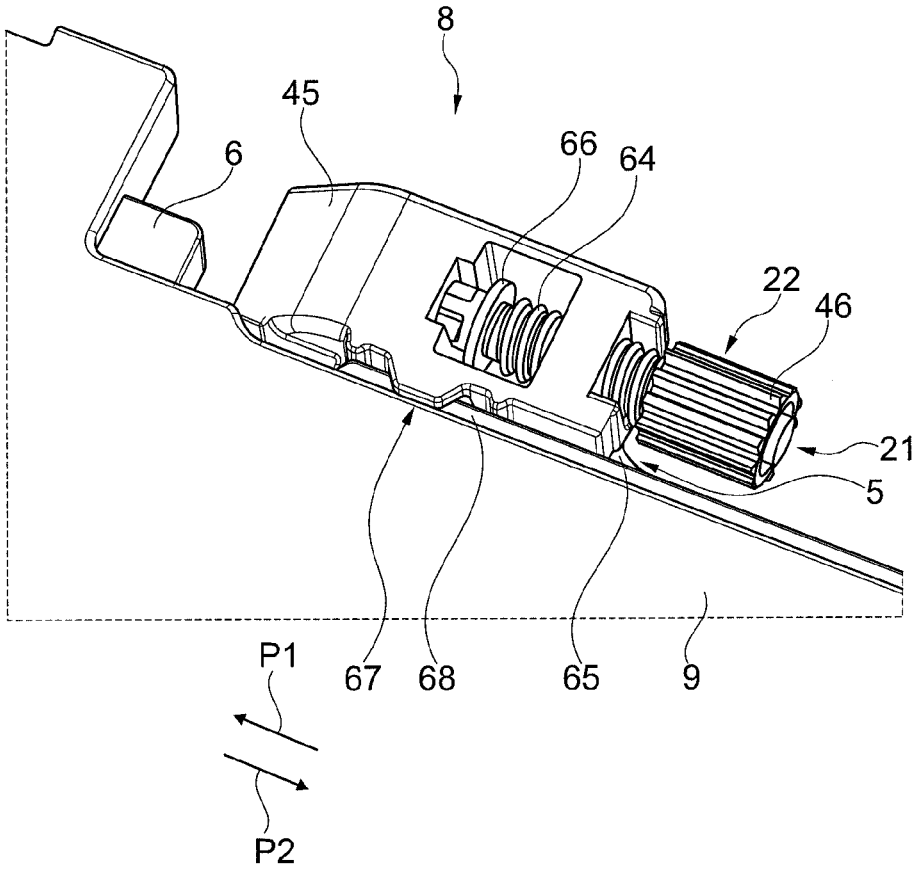
FIG. 10 shows an adjustment assembly of the device as per FIG. 9, having a setting element in the minimum position on the housing of the adjustment assembly.
Figure 11:
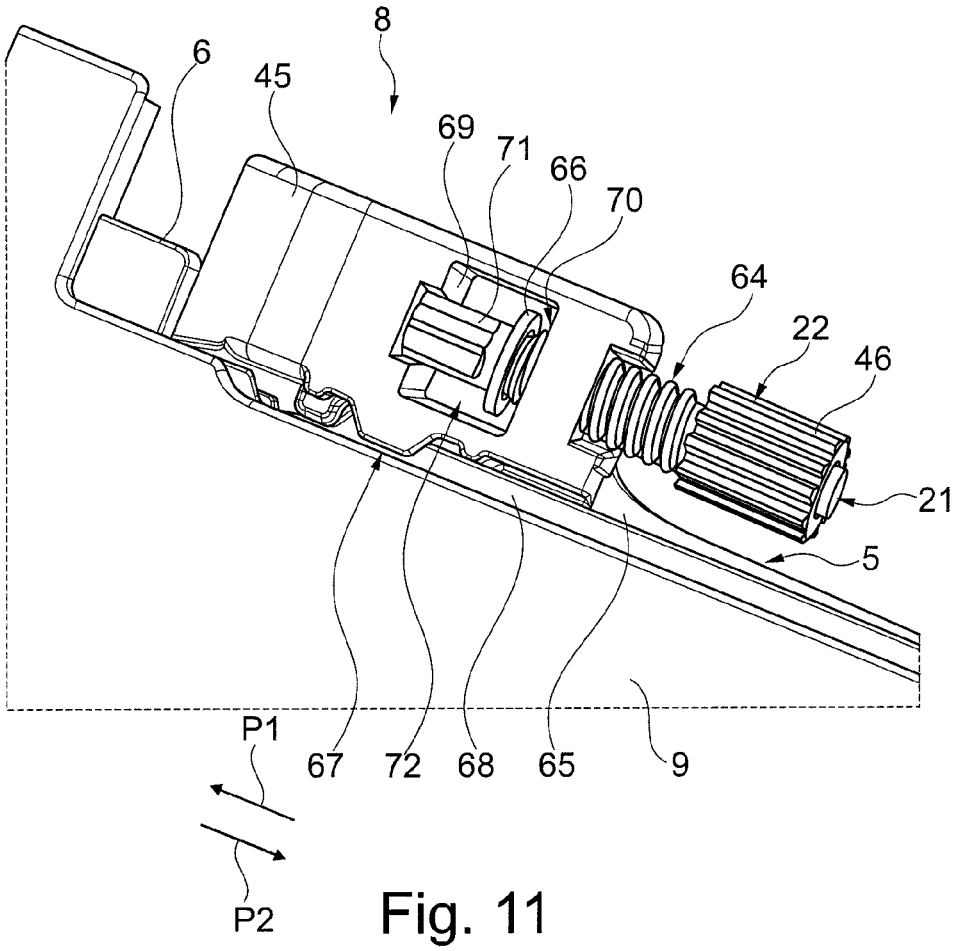
FIG. 11 shows an adjustment assembly as per FIG. 10, in a perspective view from obliquely below, having the setting element in the maximum position on the housing of the adjustment assembly.

The set screw 22 has an external thread 64 which interacts with an internal thread on the housing 45 of the front-gap adjustment assembly 8. Depending on the rotation direction of the set screw 22, a position of the contact portion 21 of the set screw 22 is adjustable in the direction P1 or P2 by simple intuitive manual rotation of an operating portion 46 of the set screw 22 by a user. In particular, the set screw 22 is configured so as to be self-locking in relation to the housing 45 of the front-gap adjustment assembly 8. A measure of a front gap between the drawer front 55 and the drawer 53, which is closed on the basic furniture structure 51, and end sides of the basic furniture structure 51 is capable of being predefined by way of the predefined position of the set screw 22 (FIGS. 10, 11).

Once the set screw 22 has been inserted into the housing 45 of the front-gap adjustment assembly 8, the annular stop element 66 which is configured as a circlip is clamped or clip-fitted onto the set screw 22 in the opening 72. A minimum or maximum position of the set screw 22 on the housing 45 of the front-gap adjustment assembly 8 is capable of being predefined by the stop element 66. The position is capable of being predefined when, in particular, by continuous readjustment of the set screw 22 by a user in the direction P1 or P2, respectively, the stop element 66 bears on stops 69, 70 on the housing 45 of the front-gap adjustment assembly 8.

Furthermore, the set screw 22 comprises a guide pin 71. The set screw 22 by way of the guide pin 71 is adjustably guided in a bore on the housing 45 of the front-gap adjustment assembly 8.

The contact portion 21 of the set screw 22 in the tensioned or charged state, respectively, of the force accumulator 3 bears on an entrainment element 23 which in respective operational states forms a stop for the contact portion 21. The entrainment element 23 which in FIGS. 3 to 8 is merely indicated by dashed lines may be present on a fixed rail of the guide means 52, for example, or be attached to the basic furniture structure 51 when the ejector unit 1 is disposed on the drawer 53.

However, if and when the ejector unit 1 is disposed on the basic furniture structure 51 or on a positionally fixed part of the guide means 52 of the item of furniture 50, the entrainment element 23 may be present on the drawer 53 and thus be movable in relation to the basic furniture structure 51.

If and when, proceeding from the basic position of the ejector unit 1 according to FIG. 3, a locking feature is cancelled on the ejector unit 1, as is shown in FIG. 4 and will be explained in more detail below, the tensioned or charged force accumulator 3, respectively, pulls the entrainment element 18 in the direction P2, the latter by way of the stop element 26 urging or sliding, respectively, the ejector 5 in relation to the base plate 2 in the direction P2.

As soon as the ejector 5 on the base plate 2 moves in the direction P2, a latch component 24 of the ejector unit 1, which is pivotably mounted on the ejector 5, is put from an inwardly pivoted position according to FIG. 4, in which the latch component 24 in relation to the external periphery of the base plate 2 is completely retracted, to an outwardly pivoted position in which the latch component 24 by way of a cam partially projects beyond the external periphery of the base plate 2 (FIG. 5), this being implemented by way of a loop-shaped closed guide track 25 in the base plate 2 and by way of a guide pin 24*a*, engaging is the guide track 25, on the latch part 24.

In order for the latch component 24 to be illustrated, the outline thereof which is obscured by other components, in particular, by the ejector 5, in FIGS. 3 to 8 is indicated with dashed lines.

In the basic state which is illustrated in FIG. 5, the force accumulator 3 is located in a terminal position of the discharged state, wherein the force accumulator 3 is unable to move the ejector 5 any farther in the direction P2.

By virtue of the kinetic energy of the drawer 53, caused by the preceding ejection movement and/or by the drawer 53 being manually moved farther in the opening direction M1 by a user, the ejector 5 is subsequently displaced in relation to the base plate 2 in the direction P2. This is possible because the latch component 24 which has been outwardly pivoted so as project from the ejector 5 bears on the entrainment element 23, the ejector 5 in the further course of the movement of the drawer thus reaching the terminal position thereof which is displaced to a maximum in the direction P2 on the base plate 2. By reaching the terminal position on the ejector 5, the latch component 24 is again completely pivoted inwardly, this being predefined by the interaction between the guide track 25 and the guide pin 24*a* on the latch component 24 being engaged therein.

If and when the drawer 53 following a discharging procedure of the force accumulator 3 is moved farther in the opening direction M1, the ejector unit 1 separates from the entrainment element 24, cancelling contact between the entrainment element 23 and the contact portion 21 of the set screw 22 (FIG. 6).

From the terminal position described above, which the ejector assumes only briefly, the ejector 5 by spring elements 33 on the base plate 2 is urged by, for example, a few millimeters in the direction P1. In relation to the coil springs 10, 11 of the force accumulator 3, the spring elements 33 have a comparatively minor force. By way of the movement of the ejector 5 in the direction P1 by way of the force of the spring element 33, a bearing portion 29 of the latch component 24 in a standby position of the ejector 5 is put in direct clearance-free contact with a mounting pin 31 of a tension lever 30 of the coupling installation 4 (FIG. 6). The mounting pin 31 is disposed on a first end of the tension lever 30 and may move freely along a, for example, linear, guide track 27 and/or a linear guide 63 which is configured on the ejector 5, and, in particular, within an opening procedure of the drawer 53, until the latch component 24 holds the mounting pin 31 and/or the tension lever 30 in direct, clearance-free contact with the ejector 5.

The standby position of the ejector 5 which is shown in FIG. 6 at the same time is a starting position of the ejector 5 for a charging procedure of the force accumulator 3 by way of the coupling installation 4.

Besides, the tension lever 30, the coupling installation 4 comprises a guide lever 34 and a connection element 35. By way of a mounting pin 36, the tension lever 30 on a second end is articulated on the guide lever 34. The connection element 35, on a second end, by way of a mounting pin 37 which is spaced apart from the mounting pin 36, is likewise articulated on the guide lever 34, and on the first end thereof, the connection element 35 by way of a further mounting pin 38 is articulated on the motion element 18. The guide lever 34 at a first end by way of a mounting pin 39 is disposed so as to be movable, in particular, pivotable, on the base plate 2. The mounting pin 39 is preferably received both on the base plate 2 as well as on the cover component 9.

A longitudinal axis A1 of the tension lever 30, which runs through the mounting pins 31, 36 of the tension lever 30, in relation to a first longitudinal axis A2 of the guide lever 34, which runs through the mounting pins 36, 39, has an angle $\alpha$.

A longitudinal axis A3 of the connection element 35, which runs through the mounting pins 37, 38 of the connection element 35, in relation to a second longitudinal axis A4 of the guide lever 34, which runs through the mounting pins 37, 39, has an angle $\beta$.

The guide lever 34 of the coupling installation 4, on a second end, comprises a lever attachment 40. A locking element 41 and a stop element 42 are configured on the lever attachment 40.

The terminal position of the discharged state of the force accumulator 3 (FIG. 5) is predefined by a stop of the stop element 42 of the guide lever 34 on a wall portion 47 on a step-type wall 48 of the base plate 2. The wall portion 47 is formed from an annular portion of a damping element, for example. If and when the stop element 42 of the guide lever 34 following a discharging procedure of the force accumulator 3 bears on the wall portion 47, by virtue of a remaining bias of the coil springs 10, 11 a tensile force in the direction P2 is transmitted from the motion element 18 by way of the connection element 35 to the guide lever 34. By virtue of the rigid embodiment of the coupling installation 4, or by virtue of the impact of the stop element 42 on the wall portion 47, respectively, the motion element 18 is prevented from moving farther in the direction P2, wherein the force accumulator 3 by way of the motion element 18 is held free of clearance in the terminal position of the discharged state.

In particular, the stop element 42 and/or the wall portion 47 may be designed so as to be elastic or damping, respectively, thus reducing or preventing an impact noise.

When tensioning the force accumulator 3, the guide lever 34 by virtue of the design thereof may transmit a force from the tension lever 30 to the connection element 35 at a geared up ratio.

The gear ratio is formed, on the one hand, by the ratio of the spacing of the mounting pins 39 and 36 in relation to the spacing of the mounting pins 39 and 37 on the guide lever 34 and, on the other hand, by the combined mutual circular and linear movement of the tension lever 30 and/or of the connection element 35 during the charging procedure of the force accumulator 4.

The elements of the coupling installation 4, by virtue of the arrangement of the former on the ejector unit 1, may move as follows:

The mounting pin 31 and thus the first end of the tension lever 30, by virtue of the mounting thereof in the guide track 27, may move exclusively parallel with a movement direction of the ejector 5, in particular, parallel with a movement direction of the movable furniture part 53.

The mounting pin 38 and thus the first end of the connection element 35, by virtue of the mounting thereof on the slide-type motion element 18 and thus advantageously in the guide contour 19, may move exclusively parallel with a movement direction of the motion element 18 or of the ejector 5, respectively, in particular, parallel with the movement direction of the movable furniture part 53.

The mounting pin 36 and thus the second end of the tension lever 30, by virtue of the mounting thereof at the second end of the guide lever 34, may move exclusively in a circular path about a rotation center of the mounting pin 39 of the guide lever 34.

The mounting pin 37 of the connection element 35 and thus the second end of the connection element 35, by virtue of the mounting thereof in a central region of the guide lever 34, may move exclusively in a circular path about a rotation center of the mounting pin 39 of the guide lever 34.

By virtue of the above-mentioned design, the coupling installation 4 may transmit at a geared up ratio a force for tensioning the force accumulator 3 from the ejector 5 by way of the tension lever 30 and of the guide lever 34 to the connection element 35 and thus to the force accumulator 3, and, in particular, transmit the force which is exerted by the ejector 5 in a geared down ratio to the force accumulator 3. This means that a user when charging the force accumulator 3 has to apply less force to the ejector 5 than the user would have to apply when wishing to charge the force accumulator 3 without gearing down, or when directly pulling the end 17 of the force accumulator 3 in the direction P1, respectively.

The beginning and the end of the charging procedure of the force accumulator 3 or of the coil springs 10, 11, respectively, is visualized in FIGS. 6 and 7.

Tensioning of the force accumulator 3 is performed by a movement of the drawer 53 in the case of closing, or on a part-distance of the closing movement of the drawer 53. The starting position of the ejector unit 1, in which the latter is prepared for tensioning of the force accumulator 3 and expects a closing procedure of the drawer, is shown in FIG. 6.

If and when the drawer 53 is closed, for example, from the outside by a user, the ejector unit 1 moves in the direction M2 toward the entrainment element 23. The charging procedure of the force accumulator 3 begins as the contact portion 21 of the set screw 22 of the ejector 5 impacts on the entrainment element 23. The ejector 5, by impacting on the entrainment element 23, is moved in the direction P1, for example, by virtue of the inertia of the drawer 53 in relation to the base plate 2.

By way of the coupling of the ejector 5 to the force accumulator 3 by way of the coupling installation 4, the motion element 18 of the force accumulator 3 is likewise displaced in relation to the base plate 2 in the direction P1, and the second end 17 of the coil springs 10, 11 is displaced in the direction P1, the coil springs 10, 11 thus being elongated.

At the end of the tensioning procedure of the force accumulator 3, the ejector 5 is located in a terminal charging position, as is shown in FIG. 7. In a tensioned state of the force accumulator 3, the ejector unit 1 is located in a locked state.

In the locked state, a locking state is determined by the locking element 41 of the coupling installation 4 and by the locking member 7 which is configured as a flap, wherein a discharging movement of the coupling installation 4 is blocked by the locking member 7.

Tensioning of the force accumulator 3 is fully completed prior to an automatic retracting feature for the force-assisted retraction of the drawer 53 to the fully closed position on the basic furniture structure 51 becoming effective, for example. The automatic retracting feature is not part of the ejector unit 1, and is integrated, for example, in the guide means 52 or in the part-pullouts or full-pullouts, respectively.

After the force accumulator 3 has been tensioned, the ejector 5 by virtue of bearing on the entrainment element 23 is moved farther in direction P1 in relation to the base plate 2 by way of the further closing movement of the drawer 53. Herein, the operational connection between the latch component 24 of the ejector 5 and the mounting pin 31 of the tension lever 30 is cancelled. This is performed by an interaction between the guide track 25 and the guide pin 24*a* on the latch component 24, wherein the latch component 24 by the guiding of the guide pin 24*a* in the guide track 25 is pivoted away from the mounting pin 31 (FIG. 8). In this state, the ejector 5 is uncoupled from the coupling installation 4 and is displaceable so far in the direction P1, in particular, by an automatic retracting feature, until the drawer 53 is fully closed on the basic furniture structure 51, and the ejector 5 bears on the activator 6 in the basic position according to FIG. 3.

In the basic position of the ejector unit 1 according to FIG. 3, it is possible for a user to pull the drawer 53 in the opening direction M1 without an ejector function or without first manually cancelling the locking state, respectively. Herein, the force accumulator 3 of the ejector unit 1 is non-actuated or charged, respectively.

In order for the drawer 53 by way of the ejector unit 1 to be expelled from the position in which said drawer 1 is completely retracted or closed, respectively, on the basic furniture structure 51, a user has to act on the drawer while pushing from the outside in the direction M2. To this end, the ejector unit 1 has a so-called touch-latch function which knows a locked state which is unlockable in that the retracted drawer 53 which is closed on the basic furniture structure 51 is moved in the closing direction M2. This closing movement, or inwardly pushing the drawer 53 in the direction M2, respectively, is performed until a stop position corresponding to a front gap which in the closed state of the drawer 53, is predefined, in particular, by way of a spacing between an internal side of the drawer front 55 and a forward end side or the side walls 56 of the basic furniture structure 51, respectively, is reached. The front gap is typically a few millimeters, for example, approx. 1 to 10 millimeters.

Accordingly, unlocking of the ejector unit 1 is adapted in such a manner that a closing movement of the drawer 53 in the direction M2 of a few millimeters, or at maximum by the value of the front gap, respectively, is sufficient for unlocking and thus the force-assisted ejection of the drawer 53 to be reliably predefined.

Proceeding from the basic position according to FIG. 3, the ejector unit 1 together with the drawer 53 is moved in the direction M2. Since the set screw 22 bears on the entrainment element 23, the ejector 5 is moved in relation to the base plate 2 in the direction P1, a contact portion 44 on the ejector 5 thus pressing against the activator 6, accordingly pushing the latter in the direction P1. The activator 6 is present on the base plate 2 so as to be linearly displaceable in a limited manner, typically by a few millimeters or by less than the dimension of the front gap, respectively, in the directions P1 and P2.

The activator 6 is preferably directly coupled to the locking member 7 which is designed as a flap 43 in such a manner that the linear activation movement of the activator 6 in the direction P1 sets the flap 43 in rotary motion about a pivot axis D. The flap 43 by the rotating movement is released from a locked position into which the flap 43 is urged by a spring member which is configured as a leaf spring 49. In the locked state of the ejector unit 1, the flap 43 which is located in the locking position blocks the guide lever 34 or the lever attachment 40, respectively, in such a manner that the force accumulator 3 remains in the charged state thereof.

Blocking of the guide lever 34 is cancelled by the rotating movement of the flap 43. The locking element 41 on the lever attachment 40, which is biased by a leg spring 60, hereby preferably pivots out.

The locking element 41, which projects from the lever attachment 40, moves conjointly with the pivoting procedure of the guide lever 34 below the flap 43, past the latter, and leads further without interruption the rotating movement of the flap 43, initiated by the activator 6, about the pivot axis D. On account thereof, a rotation angle of the flap 43 out of the locking position is advantageously enlarged. The ejector unit 1 is reliably unlocked by the movement of the lever attachment 40 below and past the flap 43 and continued by the outwardly pivoting locking element 41. To this end, a comparatively very minor linear activation movement of the activator 6 in the direction P1 is required. Subsequently, the flap 43 by the leaf spring 49 is urged back into the locking position of the former.

The locking element 41 which is present so as to be outwardly pivoted on the lever attachment 40 is again brought to bear on a front edge of the flap 43 when the force accumulator 3 is tensioned. Herein, the locking element 41 yields counter to the spring force of the leg spring 60, such that said locking element 31 is retracted so far on a periphery of the lever attachment 40 that the guide lever 34 by way of the lever attachment 40 can pivot past the flap 43.

Behind the flap 43, the locking element 41 is outwardly pivoted again by the spring force of the leg spring 60. Following the tensioning procedure, the guide lever 34 by way of the projecting locking element 41 is pushed against the flap 43 which is held by the leaf spring 49 so as to lock, the force accumulator 3 thus being in the locked state.

The rotating movement of the flap 43 of the ejector unit 1, or of the device 58, respectively, is transmitted by a synchronizer bar 61 which is disposed so as to be rotationally fixed on the flap 43 to a second device 62 which is advantageously of identical action and which is disposed on the drawer 53.

The synchronizer bar 61 advantageously connects the locking member 7 to a second locking member which is present on the second device 62. The two locking members are thus directly and/or synchronously coupled in terms of motion. This represents a synchronizing principle which is contrarian to a connection between activator element of two ejector units on one furniture part.

LIST OF REFERENCE SIGNS

1 Ejector unit
2 Base plate
3 Force accumulator
4 Coupling installation
5 Ejector
6 Activator
7 Locking member
8 Front gap adjustment assembly
9 Cover component
10 Coil spring
11 Coil spring
12 End
13 Fixed mounting
14 Mounting part
15 Set part
16 Operating portion
17 End
18 Motion element
19 Guide contour
20 Linear guide
21 Contact portion
22 Set screw
23 Entrainment element
24 Latch component
**24*a*** Guide pin
25 Guide track
26 Stop element
27 Guide track
29 Stop portion
30 Tension lever
31 Mounting pin
32 Retaining member
33 Spring element
34 Guide lever
35 Connection element
36 Mounting pin
37 Mounting pin
38 Mounting pin
39 Mounting pin
40 Lever attachment
41 Locking element
42 Stop element
43 Flap
44 Contact portion
45 Housing
46 Operating portion
47 Wall portion
48 Wall
49 Leaf spring
50 Item of furniture
51 Basic furniture structure
52 Guide means
53 Drawer
54 Drawer base
55 Drawer front
56 Side wall
57 Rear drawer wall
58 Device
59 Basic structure side wall
60 Leg spring
61 Synchronizer bar
62 Device
63 Linear guide
64 External thread
65 Attachment portion
66 Stop element
67 Member
68 Guide portion
69 Stop

70 Stop
71 Guide pin
72 Opening

The invention claimed is:

1. A device for moving a movable furniture part by way of guide means relative to a basic furniture structure of an item of furniture in an opening direction to an open position and in a closing direction counter to the opening direction to a closed position, and for adjusting a front gap defined between the movable furniture part and the basic furniture structure in the closed position, the device comprising: a force accumulator such that by way of the device which is fitted to the item of furniture the movable furniture part in the case of an opening procedure by action of the force accumulator is capable of being put in the opening direction, wherein in the case of a movement of the movable furniture part in the closing direction, a charging procedure of the force accumulator is performed, and a front gap adjustment assembly positioned in the device to adjust the front gap, wherein the movable furniture part is capable of being put in motion from the closed state in the closing direction, wherein a movement length of the movable furniture part in the closing direction is designed in such a manner that the charged force accumulator is unlocked, and wherein the front gap adjustment assembly comprises an elastic member.

2. A device according to claim 1, wherein the front gap adjustment assembly further comprises a self-locking setting element.

3. A device according to claim 1, wherein the front gap adjustment assembly further comprises an elastic stop member, wherein the elastic stop member is configured on the front gap adjustment assembly in such a manner so as to couple with an entrainment element of at least one of the movable furniture part and/or of the guide means.

4. A device according to claim 1, wherein the front gap adjustment assembly further comprises a setting element, a housing, and a stop element mounted on the housing, wherein the stop element is configured to predefine at least one of a minimum and a maximum position of the setting element.

5. A device according to claim 1, wherein the front gap adjustment assembly is disposed on the movable furniture part.

6. A device according to claim 1, wherein the front gap adjustment assembly is disposed on an activator of the device.

7. An item of furniture having a device according to claim 1.

8. A device for moving a movable furniture part by way of guide means relative to a basic structure of an item of furniture in an opening direction to an open position and in a closing direction counter to the opening direction to a closed position, and for adjusting a front gap defined between the movable furniture part and the basic furniture structure in the closed position, the device comprising: a force accumulator such that by way of the device which is fitted to the item of furniture the movable furniture part in the case of an opening procedure by action of the force accumulator is capable of being put in the opening direction, wherein in the case of a movement of the movable furniture part in the closing direction, a charging procedure of the force accumulator is performed, and a front gap adjustment assembly, the front gap adjustment assembly being positioned in the device to adjust the front gap, wherein the movable furniture part is capable of being put in motion from the closed state in the closing direction, wherein a movement length of the movable furniture part in the closing direction is designed in such a manner that the charged force accumulator is unlocked, wherein the front gap is adjustable without tools, and wherein the front gap adjustment assembly comprises an elastic member.

9. A device for moving a movable furniture part by way of guide means relative to a basic furniture structure of an item of furniture in an opening direction to an open position and in a closing direction counter to the opening direction to a closed position, and for adjusting front gap defined between the movable furniture part and the basic furniture part and the basic furniture structure in the closed position, the device comprising: a force accumulator such that by way of the device which is fitted to the item of furniture the movable furniture part in the case of an opening procedure by action of the force accumulator is capable of being put in the opening direction, wherein in the case of a movement of the movable furniture part in the closing direction, a charging procedure of the force accumulator is performed, and a front gap adjustment assembly, the front gap adjustment assembly being positioned in the device to adjust the front gap, wherein the movable furniture part is capable of being put in motion from the closed state in the closing direction, wherein a movement length of the movable furniture part in the closing direction is designed in such a manner that the charged force accumulator is unlocked, wherein the front gap adjustment assembly is configured on an attachment portion of an ejector of the device, and wherein the front gap adjustment assembly comprises an elastic member.

* * * * *